United States Patent [19]

Evans

[11] Patent Number: 4,687,066

[45] Date of Patent: Aug. 18, 1987

[54] ROCK BIT CIRCULATION NOZZLE

[75] Inventor: Robert F. Evans, Dallas, Tex.

[73] Assignee: Varel Manufacturing Company, Dallas, Tex.

[21] Appl. No.: 819,031

[22] Filed: Jan. 15, 1986

[51] Int. Cl.[4] ..... E21B 10/18

[52] U.S. Cl. ..... 175/340; 175/393; 175/424; 166/222; 239/489; 239/590.5

[58] Field of Search ..... 175/340, 393, 417, 418, 175/422 R; 166/222, 223; 239/463, 487, 489, 557, 590.5, 601

[56] References Cited

U.S. PATENT DOCUMENTS

| | | | |
|---|---|---|---|
| Re. 31,495 | 1/1984 | Zublin | 166/223 |
| 2,122,808 | 7/1938 | Catland | 175/340 |
| 3,275,248 | 9/1966 | O'Brien et al. | 239/489 |
| 3,536,263 | 10/1970 | Parker | 239/601 |
| 4,106,577 | 8/1978 | Summers | 175/340 |
| 4,175,626 | 11/1979 | Tummel | 166/223 |
| 4,239,087 | 12/1980 | Castel et al. | 175/340 |
| 4,337,899 | 7/1982 | Selberg | 175/422 |

*Primary Examiner*—Stephen J. Novosad
*Assistant Examiner*—Terry Lee Melius
*Attorney, Agent, or Firm*—Harold E. Meier

[57] ABSTRACT

A drill bit having a nozzle for drilling fluid to pass out of the drill bit and into the bore hole is disclosed. In one embodiment two diagonal passages through the nozzle impart angular momentum to the drilling fluid. In another embodiment, four diagonal passages through the nozzle impart angular momentum. In still another embodiment, a central bore hole through the nozzle has helical grooves along its internal orifice wall to impart angular momentum. The angular momentum causes the drilling fluid exiting from the interior of the drill bit to flow downward into the bore hole in a divergent vortex that sweeps the cuttings away from the cutting surfaces of the drill bit.

8 Claims, 7 Drawing Figures

ROCK BIT CIRCULATION NOZZLE

TECHNICAL FIELD

This invention relates to an earth-boring rotary cone drill bit and specifically to an improved circulation nozzle for creating a vortex in the drilling fluid passing from the drill bit into the bottom of the bore hold.

BACKGROUND OF THE INVENTION

Conventionally, a rotary cone drill bit comprises a body attached to the drill string with journal legs extending downward from the body. A cone cutter is mounted on the lower end of each journal leg. As the drill string rotates the cone cutter disintegrates the earth formation beneath the drill bit and forms a bore hole.

During normal operations a drilling fluid is pumped down through the drill string and into the area around the rotary cone drill bit. Ideally the drilling fluid creates a cross-flow across the bottom of the bore hole. The drilling fluid washes the cuttings, formation fragments and other debris away from the interface of the drill bit and the formation and then carries this material through the annulus between the drill string and the bore hole up to the surface. This aids the drill bit in cutting new formation rather than recutting debris in the bore hole. However, use of prior devices for injecting drilling fluid into the bore hole has not provided efficient removal of the formation fragments to the annulus of the drill bit. Therefore the drill bit is re-cutting formation fragments during a significant part of the drilling operation. This reduces both the efficiency and the life of the drill bit.

SUMMARY OF THE INVENTION

According to the present invention drilling fluid is pumped from the interior of the body of the drill bit into the bore hole through a special easily manufactured nozzle that has openings formed at an angle to the central axis of the drill bit. The angled openings cause the drilling fluid to flow in a downwardly spinning vortex at the face of the bore hole after exiting the interior of the drill bit. The vortex of drilling fluid quickly sweeps the formation fragments and cuttings to the annulus surrounding the drill string and thus more efficiently removes those fragments from the cutting face of the drill bit. The drill bit is therefore recutting less formation fragments and is in more direct contact with uncut formation.

BRIEF DESCRIPTION OF THE DRAWINGS

A more complete understanding of the invention may be had by reference to the following detailed description when taken in conjunction with the accompanying drawings, wherein.

DETAILED DESCRIPTION

Figure 1:
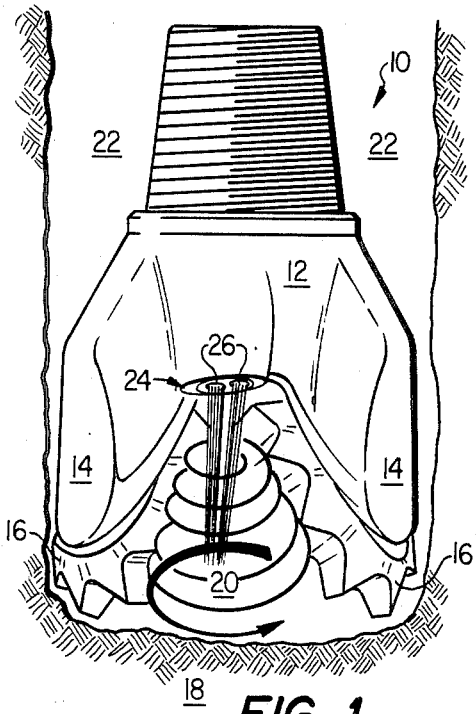
FIG. 1 shows a typical rotary cone rock bit with the nozzle of the present invention creating a vortex to sweep cuttings from the bottom of the bore hole.

FIG. 1 shows a typical rotary cone drill bit 10 comprising a body 12 extending into journal legs 14 and cone cutters 16 attached to associated journal legs 14. The cone cutters 16 disintegrate the earth formation 18 as the drill bit 10 rotates at the end of a drill string (not shown) thereby creating an earth bore hole.

Drilling fluid is pumped down through the drill string and passes through drill bit 10 and into the interior space 20 between the cone cutters 16 by means of a nozzle 24. Outlets 26 in the nozzle 24 permit drilling fluid to flow into the interior space 20. The drilling fluid sweeps the cuttings and formation fragments away from the cone cutters 16 and into the annulus 22 around the drill bit body 12. The drilling fluid and cuttings then flow up past the body 12 and the drill string and eventually flow out the top of the bore hole.

Figure 2:
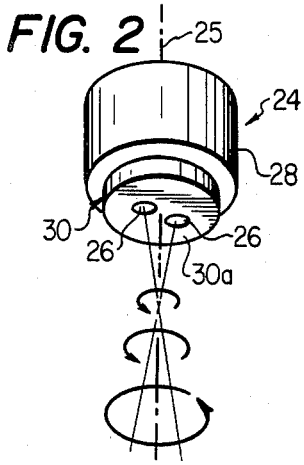
FIG. 2 is a perspective view of one embodiment of the nozzle of the present invention.
Figure 3A:
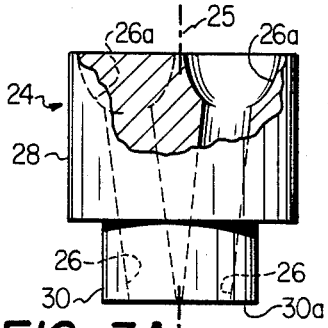
FIGS. 3A and 3B are top and side view, partially cut away and in phantom, of the nozzle of FIG. 2.
Figure 3B:
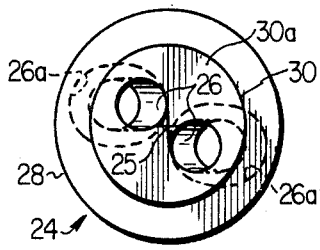

Referring now to FIGS. 2, 3A and 3B, the nozzle comprises a base 28 and a top 30 having a face surface 30A. Passages 26 are formed diagonally through the nozzle 24 and offset from the central axis such that the two streams shown in this embodiment intersect at a distance spaced from the face surface 30A. The passages 26 are thus aligned so that when the drilling fluid exits therefrom, a vortex of drilling fluid is formed in the interior space 20 as shown in FIG. 1. As shown in FIGS. 3A and 3B, the passages 26 are not formed on a line parallel to the central axis 25 of the nozzle 24 but rather are formed diagonally along lines skew to the central axis and to each other. The innermost end 26*a* of the passages 26 is formed as an ellipsoid to increase the velocity of drilling fluid from the nozzle.

Figure 4:
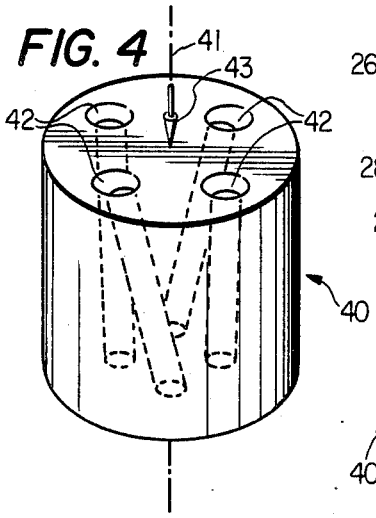
FIG. 4 is a perspective view of a second embodiment of the invention.
Figure 5:
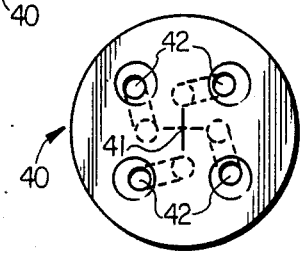
FIG. 5 is a top view of the second embodiment of the invention showing passages in phantom.

Referring to FIGS. 4 and 5, there is shown an alternate embodiment of the present invention viewed from the inner end of the nozzle. A nozzle 40 has four passages 42 through which the drilling fluid exists into the bore hole in the direction of the arrow 43. As shown in FIG. 5, each of four passages 42 is formed diagonally through the nozzle 40 along a line skew to the central axis 41 of the nozzle. The passages 42 are angled convergent orifices that create a vortex in the drilling mud in the interior space 20 in the same manner as the passages 26 of the nozzle 24 shown in FIGS. 2, 3A and 3B.

Figure 6:
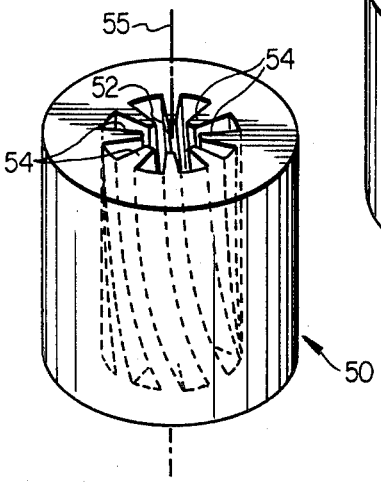
FIG. 6 is a perspective view of a third embodiment of the invention showing passages in phantom.

Referring to FIG. 6, in another embodiment of the present invention a nozzle 50 has a single bore 52 located along a central axis 55. A plurality of helical grooves 54 are formed along the outer surface of the bore 52. The helical grooves 54 cause the drilling fluid exiting the nozzle 50 to form a vortex in the interior space 20 of the rock bit.

In operation, because of the special design of the passages 26, and 42, and of the grooves 54, the drilling fluid in the interior space 20 of the rotary cone rock bit flows in a downwardly oriented divergent vortex. The vortex creates a cross-flow across the bottom of the bore hole and efficiently sweeps the cuttings and formation fragments to the annulus 22 of the drill string. Therefore, the cone cutters 16 are in contact with uncut formation rather than cuttings or formation fragments and so the drill bit is more efficient and has a longer useful life than prior rotary cone drill bits. The passages 26 or 42 or helical grooves 54 are designed to create a vortex flowing either clockwise or counterclockwise.

While the invention has been shown in several embodiments, it will be apparent to those skilled in the art that it is not so limited but is susceptible to various changes and modifications without departing from the spirit thereof.

We claim:

1. A drill bit having a body with a central axis, at least one cutting face, and a means for containing drilling fluid in the body of the drill bit, the improvement comprising:

a nozzle mounted on the central axis of the drill bit body for ejecting the drilling fluid from the body of the drill bit into the space at the bottom of a bore hole to thereby cause the drilling fluid to form a downwardly directed vortex in the space above the bottom of the bore hole and to sweep cuttings away from the cutting face of the drill bit, said nozzle comprising a base having at least two outlets formed therethrough, each of said outlets having a center axis directed at an angle skew to the center axis of each of the other outlets and to the central axis of the body and the center axis of each outlet having a partial horizontal component radially directed toward and skew to the central axis of the body.

2. The drill bit of claim 1 wherein the nozzle has at least two angular outlets with directed openings aligned to impart a vertical and horizontal component to the drilling fluid.

3. The drill bit of claim 1 wherein the nozzle has a plurality of angled convergent outlets with directed openings to impart a horizontal and a vertical component to the drilling fluid.

4. A drill bit having a body with a central axis, at least one cutting face, and a means for containing drilling fluid in the body of the drill bit, the improvement comprising:

a nozzle mounted on the central axis of the drill bit body for ejecting the drilling fluid from the body of the drill bit into the space at the bottom of a bore hole to thereby cause the drilling fluid to form a downwardly directed vortex in the space above the bottom of the bore hole and to sweep cuttings away from the cutting face of the drill bit, said nozzle including:

a base;

a top having a top face surface directed topward the bore hole; and a plurality of passages formed through the nozzle at angles diagonally offset from the central axis of the drill bit, said passages being aligned to impart an angular velocity to the drilling fluid ejected into the bore hole, each of said passages having a center axis directed at an angle skew to the center axis of each of the other passages and to the central axis of the body; the center axis of each passages having a partial horizontal component radially directed toward and skew to the central axis of the body.

5. The drill bit of claim 4 wherein said passages have an innermost opening opposite said top face surface and wherein the passages have a greater cross sectional area at the innermost face surface than at the top face surface.

6. The drill bit of claim 4 wherein said passages are equally offset from the central axis of the drill bit.

7. The drill bit of claim 4 including a plurality of said passages each having an angled convergent outlet with directed openings to impart a horizontal and a vertical component to the drilling fluid.

8. A drill bit having a body with a central axis, at least one cutting face, and a means for containing drilling fluid in the body of the drill bit, the improvement comprising:

a nozzle mounted on the central axis of the drill bit body for ejecting the drilling fluid from the body of the drill bit into the space at the bottom of a bore hole to thereby cause the drilling fluid to form a downwardly directed vortex in the space above the bottom of the bore hole to sweep cuttings away from the cutting face of the drill bit, said nozzle including:

a base having a central axis;

a bore down the central axis of the base; and a plurality of helical grooves formed along the outer surface of the bore for imparting angular momentum to a portion of said drilling fluid, wherein the width of each of said grooves is greater at the edge of the groove toward the outer circumference of the nozzle than at the intersection of the groove and the outer surface of the bore.

* * * * *